US009089019B2

(12) United States Patent
Darshan

(10) Patent No.: US 9,089,019 B2
(45) Date of Patent: Jul. 21, 2015

(54) POWER SAVING ARRANGEMENT FOR USE WITH A USER IMPLEMENTABLE PHASE CUT DIMMER

(75) Inventor: Yair Darshan, Petach Tikva (IL)

(73) Assignee: Microsemi Corp.—Analog Mixed Signal Group, Ltd., Hod Hasharon (IL)

( * ) Notice: Subject to any disclaimer, the term of this patent is extended or adjusted under 35 U.S.C. 154(b) by 961 days.

(21) Appl. No.: 13/251,320

(22) Filed: Oct. 3, 2011

(65) Prior Publication Data

US 2012/0086361 A1 Apr. 12, 2012

Related U.S. Application Data

(60) Provisional application No. 61/392,448, filed on Oct. 12, 2010.

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0815; H05B 33/0845; H05B 37/02; H05B 33/0809; H05B 33/0848; H05B 39/04
USPC ..... 315/209 R, 220, 194, 195, 246, 276, 315/277, 287, 291, 225, 210, 212, 213
See application file for complete search history.

(56) References Cited

U.S. PATENT DOCUMENTS

| | | | | |
|---|---|---|---|---|
| 8,102,167 | B2 * | 1/2012 | Irissou et al. | 323/300 |
| 8,222,832 | B2 * | 7/2012 | Zheng et al. | 315/291 |
| 8,536,799 | B1 * | 9/2013 | Grisamore et al. | 315/294 |
| 8,541,952 | B2 * | 9/2013 | Darshan | 315/209 R |
| 2007/0138971 | A1 * | 6/2007 | Chen | 315/209 R |
| 2007/0182338 | A1 * | 8/2007 | Shteynberg et al. | 315/200 R |
| 2008/0258647 | A1 | 10/2008 | Scianna | |
| 2009/0160627 | A1 | 6/2009 | Godbole | |

(Continued)

FOREIGN PATENT DOCUMENTS

WO 2009/120555 A1 10/2009

OTHER PUBLICATIONS

Intersil ISL97801 Data Sheet; Apr. 2007; Intersil Americas Inc, Milpitas, CA.

(Continued)

*Primary Examiner* — Tung X Le
*Assistant Examiner* — Amy Yang
(74) *Attorney, Agent, or Firm* — Simon Kahn

(57) ABSTRACT

A power saving arrangement for use with a phase cut dimmer, the power saving arrangement constituted of: a power converter arranged to convert a received alternating current power signal to a direct current signal; a detector arranged to detect the presence, or absence, of the phase cut dimmer blocking a portion of an alternating current mains power sine wave from reaching the power converter; and a controllable minimum holding current circuit in communication with the received alternating current power signal, the controllable minimum holding current circuit responsive to an output of the detector, wherein in the event that the detector detects the absence of the phase cut dimmer, the controllable minimum holding current circuit is disabled such that a minimum holding current is not provided.

16 Claims, 4 Drawing Sheets

(56) References Cited

U.S. PATENT DOCUMENTS

| | | | |
|---|---|---|---|
| 2009/0167203 | A1 | 7/2009 | Dahlman |
| 2009/0243582 | A1 | 10/2009 | Irissou |

OTHER PUBLICATIONS

Supertex HV9931 Data Sheet; 2008; Supertex Inc., Sunnyvale, CA.
National Semiconductor LM3445 Data Sheet; Jul. 16, 2010; National Semiconductor Corporation, Santa Clara, CA.
Maxim MAX16801A Data Sheet; Jan. 2010; Maxim Integrated Products, Sunnyvale CA.
ON Semiconductor NCL30001 Data Sheet; Mar. 2010; ON Semiconductor, Denver, CO.
NXP SLL2101 Data Sheet; Aug. 2009; NXP Semiconductors B. V., Eindhoven, Netherlands.
TI UCC28810 Data Sheet; Oct. 2008; Texas Instruments, Dallas, TX.
LNK403-409EG Data Sheet; Jun. 2010; Power Integrations, San Jose, CA.
LNK454-456-458/460 Data Sheet; Jun. 2010; Power Integrations, San Jose, CA.

* cited by examiner

POWER SAVING ARRANGEMENT FOR USE WITH A USER IMPLEMENTABLE PHASE CUT DIMMER

CROSS-REFERENCE TO RELATED APPLICATION

This application claims priority from U.S. Provisional Patent Application Ser. No. 61/392,448 filed Oct. 12, 2010, entitled "A Power Saving Arrangement for Use with a User Implementable Phase Cut Dimmer", the entire contents of which is incorporated herein by reference.

BACKGROUND OF THE INVENTION

The present invention relates to the circuits for use with a user implementable dimmer, and in particular to a power saving arrangement for use with a user implementable phase cut dimmer, wherein the presence or absence of a dimmer is detected and a minimum hold current element is enabled or disabled respectively responsive to the detection.

Solid state lighting, and in particular light emitting diodes (LEDs) are rapidly coming into wide use for lighting applications. In most general lighting applications the LEDs are supplied in one or more strings of serially connected LEDs, thus sharing a common current.

LEDs providing high luminance exhibit a range of forward voltage drops, denoted $V_f$, and their luminance is primarily a function of current. Brightness control of the LEDs may be performed by either pulse width modulation (PWM) or by amplitude modulation. In a PWM brightness control a fixed current is driven through the LED string, and the duty cycle of the fixed current is adjusted in order to control the LED string brightness. In amplitude modulation the amount of current through the LED string is varied directly, thus adjusting the brightness. LED strings exhibit a particular voltage to current relationship, wherein for a voltage below a minimum operating voltage no appreciable current flows, and for voltages exceeding the minimum operating voltage the current follows an exponential curve responsive to the voltage.

A phase cut dimmer is a device arranged to provide control of the brightness of lighting source by blocking a portion of the alternating current (AC) mains power sine wave from reaching the lighting source. Both leading edge dimmers, wherein the leading edge of the sine wave is blocked by a settable conduction angle, and trailing edge dimmers wherein a trailing edge of the sine wave is blocked, are commercially available. Other phase cut dimmers which allow selection of the portion of the sine wave to pass are also known. Phase cut dimmers are typically implemented by thyristors which require a minimum holding current, denoted $I_h$ to operate smoothly, as described inter alia in U.S. Patent Application Publication S/N 2008/0258647 published Oct. 23, 2008 to Scianna, the entire contents of which is incorporated herein by reference. Minimum holding current $I_h$ is also known as the hypostatic current.

A solid state lighting driver may exhibit extremely low currents in certain states of operation, such as a start up state, or a low brightness state, or whenever a sine wave source approaches zero, which may be insufficient to maintain the minimum holding current $I_h$ thus resulting in flicker or reduced brightness when used with phase cut dimmers, particularly pre-installed commercially available phase cut dimmers. It is thus common practice to provide some sort of dummy load in parallel with the solid state lighting driver to ensure provision of minimum holding current $I_h$, however the existence of such a dummy load wastes energy, particularly in the event that the dummy load is provided when no dimmer is attached.

SUMMARY OF THE INVENTION

Accordingly, it is a principal object of the present invention to overcome at least some of the disadvantages of prior art solid state lighting drivers. This is provided in certain embodiments by a detector arranged to detect the presence or absence of a phase cut dimmer and a controllable minimum holding current circuit responsive to an output of the detector. In the event that the presence of a phase cut dimmer is detected, the minimum holding circuit is enabled to ensure the supply of a minimum holding current to the phase cut dimmer. In the event that the presence of a phase cut dimmer is not detected, the minimum holding circuit is disabled thus reducing power lost due to the minimum holding current.

In one particular embodiment the detector is arranged on the secondary side of a power converter. In one yet further embodiment the detector is arranged to subtract an output voltage of the secondary side of the power converter thus providing improved detection over a wide range of input voltages, output voltages and load conditions.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
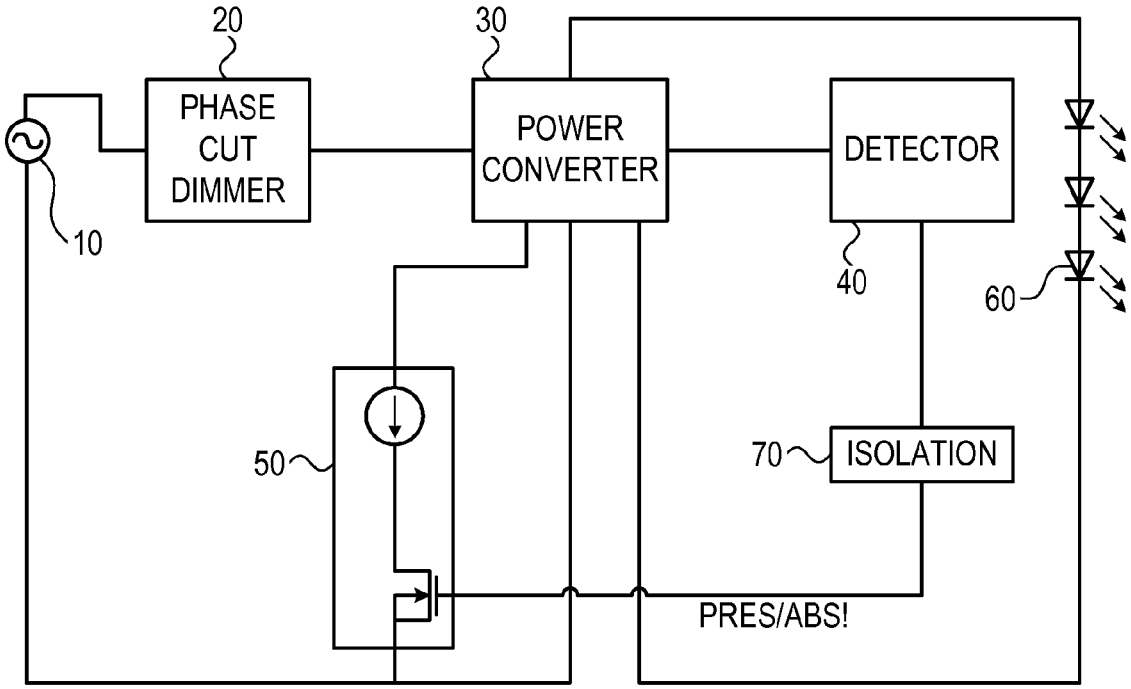
FIG. 1 illustrates a high level block diagram of a power saving arrangement for use with a user implementable phase cut dimmer, the power saving arrangement comprising a controllable minimum holding current circuit responsive to a detector.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 illustrates a high level block diagram of a power saving arrangement for use with a user implementable phase cut dimmer 20, the power saving arrangement further comprising: an AC mains power source 10, a power converter 30; a detector 40; a controllable minimum holding current circuit 50, illustrated without limitation as a current source connected in series with an electronically controlled switch; a load 60, illustrated without limitation as an LED string; and an isolating device 70. A phase output of AC mains power source 10 is connected via user implementable phase cut dimmer 20 to an input of power converter 30 and the neutral of AC mains power source 10 is connected to a return of power converter 30. A first end of controllable minimum holding current circuit 50 is connected to power converter 30, preferably to the output of a full wave rectifier at the input thereof, and a second end of controllable minimum holding current circuit 50 is connected to the neutral output of AC mains power source 10. A first output of power converter 30 is connected to an input of detector 40 and an output of detector 40, denoted PRES/ABS!, is connected to the control input of controllable minimum holding current circuit 50 via isolating device 70. A second output of power converter 30 is connected to a first end of load 60 and a second end of load 60 is connected to a return of power converter 30.

The existence of user implementable phase cut dimmer 20 is selectable by a user without direct notification to detector 40, and the term user implementable phase cut dimmer is meant to indicate that user implementable phase cut dimmer 20 may be absent, or present, at the selection of a user.

In operation, user implementable phase cut dimmer 20, if present, blocks a portion of the sine wave power signal received from AC mains power source 10 from reaching power converter 30. It is to be noted that user implementable phase cut dimmer 20, if present, blocks a portion of the sine wave power signal received from AC mains power source 10 from reaching power converter 30 irrespective of the setting of user implementable phase cut dimmer 20. Thus, even if set for maximum brightness, user implementable phase cut dimmer 20 typically blocks at least some portion of the sine wave power signal. Power converter 30 converts the received power and provides it as a DC power to load 60. Detector 40 detects the presence, or absence, of user implementable phase cut dimmer 20 by detecting if a portion of the AC mains power sine wave received by power converter 30 has been blocked. In the event that detector 40 detects that a portion of the AC mains power sine wave has been blocked, the existence of user implementable phase cut dimmer 20 is detected, and controllable minimum holding current circuit 50 is enabled by the activation of signal PRES/ABS! thereby providing the minimum holding current. In the event that detector 40 does not detect that a portion of the AC mains power sine wave has been blocked, the absence of user implementable phase cut dimmer 20 is detected, and controllable minimum holding current circuit 50 is disabled by the deactivation of signal PRES/ABS!, thus saving power.

In an exemplary embodiment, as will be described further below in relation to FIG. 2, detection is accomplished by comparing the unblocked portion of the AC mains power sine wave received by power converter 30 with a reference percentage, such as 90%, the particular reference percentage preferably selected so as to identify over all conditions the existence of user implementable phase cut dimmer 20 set at the maximum brightness level, where the smallest portion of the AC mains power sine wave is blocked. In the event that the unblocked portion of the AC mains power sine wave received by power converter 30 is less than the reference percentage the presence of user implementable phase cut dimmer 20 is detected and in the event that the unblocked portion of the AC mains power sine wave received by power converter 30 is greater than or equal to the reference percentage the absence of user implementable phase cut dimmer 20 is detected.

The above has been described in an embodiment wherein detector 40 receives an output different from the output received by load 60, however this is not meant to be limiting in any way, and a single output to both detector 40 and load 60 may be implemented without exceeding the scope. The above has been described in an embodiment wherein detector 40 is connected to a secondary side of power converter 30, however this is not meant to be limiting in any way. In another embodiment detector 40 is provided connected to the primary side input of power converter 30, and thus isolation device 70 is not required.

Figure 2:
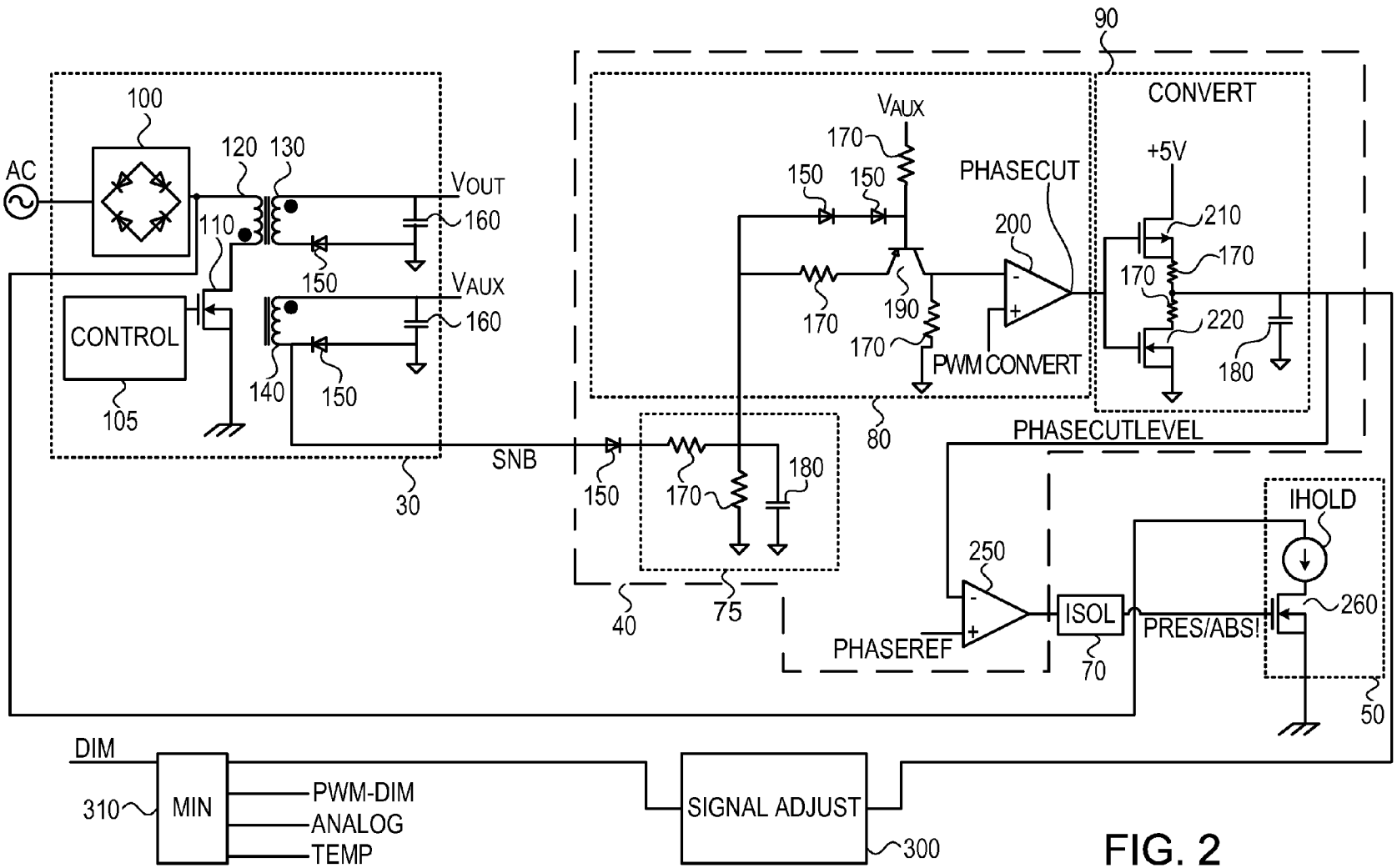
FIG. 2 illustrates a high level schematic diagram of an exemplary embodiment of the power saving arrangement of FIG. 1 implemented with a flyback converter.

FIG. 2 illustrates a high level schematic diagram of an exemplary embodiment of the power saving arrangement of FIG. 1 wherein power converter 30 is implemented in cooperation with a flyback converter. In particular the embodiment of FIG. 2 comprises power converter 30, detector 40, controllable minimum holding current circuit 50 and isolating device 70 of FIG. 1, and further comprises a signal adjustment circuit 300 and a minimum function circuit 310. Power converter 30 comprises: a full wave rectifier 100, a control circuit 105; an electronically controlled switch 110, illustrated without limitation as an NMOSFET; a first winding 120; a second winding 130; a third winding 140; a plurality of unidirectional electronic valves 150, illustrated without limitation as diodes; and a plurality of output capacitors 160. First winding 120 is magnetically coupled to each of second winding 130 and third winding 140 to form a transformer.

Detector 40 comprises a first unidirectional electronic valve 150, illustrated without limitation as a diode; a low pass filter 75; a phase cut detector 80; a signal converter 90; a comparator 250; and a percentage reference voltage, denoted PHASEREF. Low pass filter 75 comprises a first and second resistor 170 and filtering capacitor 180. Phase cut detector 80 of detector 40 comprises a second and a third unidirectional electronic valve 150, illustrated without limitation as diodes 150; a first, second and a third resistor 170; a PNP transistor 190; a comparator 200 arranged to function as a comparator; and a conversion reference voltage denoted PWMCONVERT. Signal converter 90 comprises: a first electronically controlled switch 210 implemented as a PMOSFET; a second electronically controlled switch 220 implemented as an NMOSFET; a first and a second resistor 170; and a filtering capacitor 180. Controllable minimum holding current circuit 50 comprises a current source IHOLD and an electronically controlled switch 260 illustrated without limitation as an NMOSFET. Alternatively, controllable minimum holding current circuit 50 may be implemented in a controllable current source, or controllable current source IHOLD may be replaced with a resistor without exceeding the scope.

The respective inputs of full wave rectifier 100 are connected to a phase output and common output of an AC source, such as AC mains power source 10 of FIG. 1 which may, or may not, have user implemented phase cut dimmer 20 installed between AC mains power source 10 and full wave rectifier 100, and the output of full wave rectifier 100 is connected to a first end of first winding 120 and to a first end of controllable minimum holding current circuit 50. A second end of first winding 120, with its polarity indicated by a dot, is connected to the drain of electronically controlled switch 110 of power converter 30, and the source of electronically controlled switch 110 of power converter 30 is connected to a primary side common point. The gate of electronically controlled switch 110 of power converter 30 is connected to the output of control circuit 105, whose feedback loop is not shown for simplicity.

A first end of second winding 130, with its polarity indicated by a dot, is connected to a first end of a respective output capacitor 160, and denoted VOUT. Preferably, VOUT is connected to the first end of load 60, described above in relation to FIG. 1. A second end of second winding 130 is connected to the cathode of a respective unidirectional electronic valve 150 of power converter 30, and the anode of the respective unidirectional electronic valve 150 is connected to a second end of the respective output capacitor 160, and to a secondary side common point.

A first end of third winding 140, with its polarity indicated by a dot, is connected to a first end of a respective output capacitor 160, and denoted VAUX. A second end of third winding 140 is connected to the cathode of a respective unidirectional electronic valve 150 of power converter 30 and to the anode of first unidirectional electronic valve 150 of detector 40, and is denoted SNB. The anode of the respective unidirectional electronic valve 150 of power converter 30 is connected to a second end of the respective output capacitor 160, and to the secondary side common point.

The cathode of first unidirectional electronic valve 150 of detector 40 is connected to a first end of first resistor 170 of low pass filter 75. A second end of first resistor 170 of low pass filter 75 is connected via second resistor 170 of low pass filter 75 to the secondary side common point, and in parallel via filtering capacitor 180 of low pass filter 75 to the secondary side common point. The second end of first resistor 170 of low pass filter 75 is further connected to a first end of first resistor 170 of phase cut detector 80 and to the anode of second unidirectional electronic valve 150 of phase cut detector 80. Optionally, a protection unidirectional electronic valve (not shown) is further provided between the second end of first resistor 170 of low pass filter 75 and the anode of first unidirectional electronic valve 150 and first resistor 170 of phase cut detector 80. The cathode of second unidirectional electronic valve 150 of phase cut detector 80 is connected to the anode of third unidirectional electronic valve 150 of phase cut detector 80 and the cathode of third unidirectional electronic valve 150 of phase cut detector 80 is connected to the base of PNP transistor 190 and via second resistor 170 of phase cut detector 80 to VAUX. A second end of first resistor 170 of phase cut detector 80 is connected to the emitter of PNP transistor 190 and the collector of PNP transistor 190 is connected to the secondary side common point via third resistor 170 of phase cut detector 80 and to the inverting input of comparator 200 of phase cut detector 80.

The non-inverting input of comparator 200 of phase cut detector 80 is connected to conversion reference voltage PWMCONVERT and the output of comparator 200 of phase cut detector 80 is connected to the gate of each of first electronically controlled switch 210 and second electronically controlled switch 220 of signal converter 90. The drain of first electronically controlled switch 210 of signal converter 90 is connected to a maximum range voltage, illustrated without limitation as +5V and the source of first electronically controlled switch 210 of signal converter 90 is connected to the drain of second electronically controlled switch 220 of signal converter 90 via first and second resistors 170 of signal converter 90 in series. The source of second electronically controlled switch 220 of signal converter 90 is connected to the secondary side common point. The common node of first and second resistors 170 of signal converter 90 is connected via filtering capacitor 180 of signal converter 90 to the secondary side common point, is denoted PHASECUTLEVEL and is further connected to the inverting input of comparator 250 and to the input of signal adjustment circuit 300. The output of signal adjustment circuit is connected to an input of minimum function circuit 310.

The non-inverting input of comparator 250 is connected to percentage reference voltage PHASEREF, and the output of comparator 250 is connected to the gate of electronically controlled switch 260 of controllable minimum holding current circuit 50 via isolating device 70 as signal PRES/ABS!, as described above in relation to FIG. 1. As further described above in relation to FIG. 1, the drain of electronically controlled switch 260 of controllable minimum holding current circuit 50 is connected via current source IHOLD to the output of full wave rectifier 100 and the source of electronically controlled switch 260 of controllable minimum holding current circuit 50 is connected to the primary side common point.

Figure 3A:
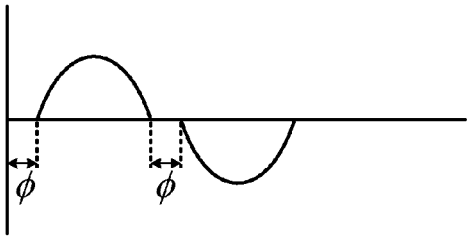
FIG. 3A illustrates an AC mains power sine wave wherein a user implementable phase cut dimmer has blocked a portion of a leading edge of the sine wave.
Figure 3C:
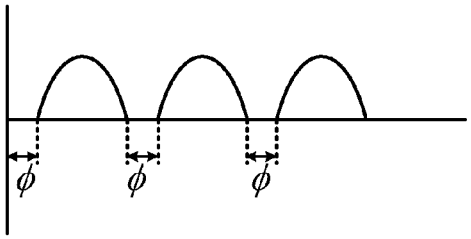
FIG. 3C illustrates a full wave rectified DC signal developed from an AC mains power sine wave in the presence of a user implementable phase cut dimmer.
Figure 3B:
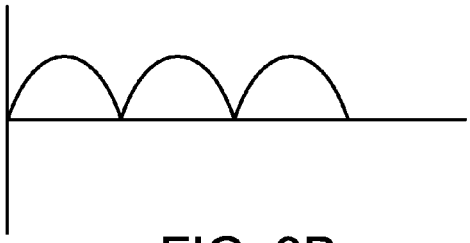
FIG. 3B illustrates a full wave rectified DC signal developed from an AC mains power sine wave in the absence of a user implementable phase cut dimmer.
Figure 3D:
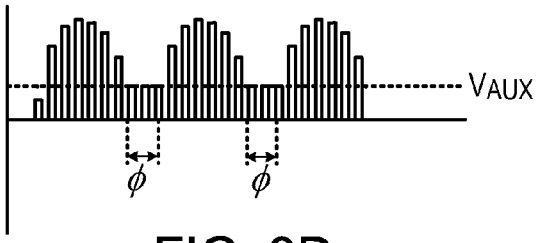
FIG. 3D illustrates the signal at a point labeled SNB of FIG. 2, which comprises a reflection of a received AC power signal superimposed onto a direct current signal.

FIG. 3A illustrates an AC mains power sine wave wherein a user implementable phase cut dimmer 20 has blocked a portion of a leading edge of the sine wave, wherein the x-axis represents time and the y-axis represents amplitude. FIG. 3B illustrates a full wave rectified DC signal output from full wave rectifier 100 of FIG. 2 developed from an AC mains power sine wave in the absence of a user implementable phase cut dimmer 20, wherein the x-axis represents time and the y-axis represents amplitude. FIG. 3C illustrates a full wave rectified DC signal output from full wave rectifier 100 of FIG. 2 developed from an AC mains power sine wave in the presence of a user implementable phase cut dimmer 20, wherein the x-axis represents time and the y-axis represents amplitude. FIG. 3D illustrates signal SNB of FIG. 2, which comprises a reflection of the received alternating current power signal superimposed onto a direct current signal VAUX, wherein the x-axis represents time and the y-axis represents amplitude.

The operation of FIG. 2 will now be described, with FIG. 3A-3D being utilized to elaborate on certain signals. An AC mains power signal is received at full wave rectifier 100. In the event that user implementable phase cut dimmer 20 is present in the connection between AC mains power source 10 and full wave rectifier 100, a portion of the sine wave from AC mains power source 10 will be blocked, illustrated as conduction angle $\phi$ of FIG. 3A. The received AC mains power signal is rectified by full wave rectifier 100, and in the absence of user implementable phase cut dimmer 20 presents a complete rectified sine wave, as illustrated in FIG. 3B, or in the presence of user implementable phase cut dimmer 20 presents a rectified sine wave reflecting blocked portion ϕ as illustrated in FIG. 3C.

Control circuit 105 alternately opens and closes electronically controlled switch 110 to convert the received power from full wave rectifier 100 to a DC power VOUT and to DC power VAUX. In particular, when electronically controlled switch 110 is closed current passes through first winding 120, substantially no current passes through second winding 130 due to the action of the respective unidirectional electronic valve 150 which is reverse biased, and substantially no current passes through third winding 140 due to the action of the respective unidirectional electronic valve 150 which is reverse biased. When electronically controlled switch 110 is opened, power is transferred to second winding 130, charging respective output capacitor 160 and flowing to load 60, and power is further transferred to third winding 140 charging respective output capacitor 160.

The voltage at SNB, is illustrated in FIG. 3D. In particular, when electronically controlled switch 110 is closed, the voltage at SNB is VAUX plus the voltage appearing across first winding 120 times the ratio of the turns between first winding 120 and third winding 140. When electronically controlled switch 110 is opened, the voltage at SNB falls to near the secondary side common point. Thus, the high frequency switching of electronically controlled switch 110 develops an envelope reflecting the value of the instantaneous voltage presented to first winding 120 by full wave rectifier 100 with the addition of VAUX. In the event that a portion of the sine wave from AC mains power source 10 is blocked by the action of user implementable phase cut dimmer 20, the envelope reflects the value VAUX.

Low pass filter 75 filters the signal appearing at SNB and removes the high frequency signal caused by the action of electronically controlled switch 110, thus leaving only the envelope described above in relation to FIG. 3D. Phase cut detector 80 subtracts voltage VAUX from the envelope. In particular, when the value of the envelope exceeds VAUX by an emitter base drop of PNP transistor 190, PNP transistor 190 conducts creating a voltage drop across third resistor 170 of phase cut detector 80. Thus, a voltage drop across third resistor 170 of phase cut detector 80 is produced during the period when the sine wave from AC mains power source 10 is not blocked, and no voltage drop across third resistor 170 of phase cut detector 170 is produced during the period when the sine wave from AC mains power source 10 is blocked. Second and third diodes 150 of phase cut detector 80 ensure proper bias for PNP transistor 190 while preventing excessive voltage from appearing at the base emitter junction of PNP transistor 190. Alternatively (not shown), a single diode whose anode is connected to the base of PNP transistor 190 may be substituted for second and third diodes 150, in the event that a proper protection circuit is further provided for the output of low pass filter 75. The output voltage developed across third resistor 170 of phase cut detector 80 is compared with conversion reference voltage PWMCONVERT by comparator 200 of phase cut detector 80 so as to develop a square wave signal, denoted PHASECUT. PHASECUT is thus a pulse width modulated signal whose duty cycle reflects the portion of the AC mains power source 10 sine wave which has not been blocked by a user implementable phase cut dimmer 20. In particular, in the absence of a user implementable phase cut dimmer 20, output PHASECUT of phase cut detector 80 may present a duty cycle in excess of 90%.

Output PHASECUT of phase cut detector 80 is expanded to swing over the range from a maximum value, illustrated as +5V to a minimum value by the action of first and second electronically controlled switches 210, 220. It is to be understood that in practice a small voltage drop may occur across third resistor 170 of phase cut detector 80 during the period when the sine wave from AC mains power source 10 is blocked due to noise in the system or any discharge from third winding 140, and thus the value for PWMCONVERT is selected so as to eliminate these small voltage drops not reflective of an actual received AC sine wave signal.

The output of first and second electronically controlled switches 210, 220 is filtered by the action of second resistor 170 and filtering capacitor 180 of signal converter 90, and fed to the inverting input of comparator 250 and to the input of signal adjustment circuit 300 and denoted as signal PHASECUTLEVEL. Signal PHASECUTLEVEL thus represents a DC value reflective of the duty cycle of signal PHASECUT output by phase cut detector 80, with the DC value ranging over the range from 0 to the preselected maximum voltage.

Signal PHASECUTLEVEL is compared with percentage reference voltage PHASEREF by comparator 250, with percentage reference voltage PHASEREF set to determine the existence, or absence, of user implementable phase cut dimmer 20. In one embodiment PHASEREF is set to be equivalent to a 90% duty cycle for signal PHASECUT, which with a maximum value of +5V represents 4.5V. In the event that the presence of user implementable phase cut dimmer 20 is detected, in particular signal PHASECUTLEVEL is less than PHASEREF, signal PRES/ABS! is asserted by comparator 250, turning on electronically controlled switch 260 of controllable minimum holding current circuit 50, thus placing current source IHOLD across the output of full wave rectifier 100 to provide the required minimum holding current for detected user implementable phase cut dimmer 20. In the event that the absence of user implementable phase cut dimmer 20 is detected, in particular signal PHASECUTLEVEL is greater than PHASEREF, signal PRES/ABS! is not asserted by comparator 250 thus turning off electronically controlled switch 260 of controllable minimum holding current circuit 50, thus removing IHOLD from across the output of full wave rectifier 100, thus providing power saving.

Signal adjustment circuit 300 is arranged to receive signal PHASECUTLEVEL and convert it to a value wherein low values are de-emphasized and higher values are emphasized. In one non-limiting embodiment signal adjustment circuit 300 is an implementation of the equation VOUT=k*PHASECUTLEVEL^4. Signal adjustment circuit 300 thus acts to reduce the diming level signal for low values of PHASECUTLEVEL, wherein only a limited amount of power is available from AC mains power supply 10, since user implementable phase cut dimmer 20 is present and is severely limiting the amount of available power reaching power converter 30. Additionally, since PHASECUTLEVEL may be unable to reach the maximum voltage level due to noise, phase cut dimmer limitations, converter 30 limitations, and/or other considerations, signal adjustment circuit 300 is operative to ensure that signal PHASECUTLEVEL is fully stretched from the minimum value to the absolute maximum allowed value, i.e. to a 100% brightness level, typically signal PHASECUTLEVEL is thus stretched by signal adjustment circuit 300 to range from a minimum value up to +5V.

The output of signal adjustment circuit 300 is fed to a first input of minimum function circuit 310. Other dimming inputs are similarly fed to other respective inputs of minimum function circuit 310, illustrated without limitation as PWM dimming value, an analog dimming value, and a temperature protection circuit, such as a thermistor, and optionally an ambient light sensor (not shown). Minimum function circuit 310 is arranged to pass the minimum value from among the various inputs to an output denoted DIM, which is preferably passed to control the amplitude of current passing through load 60. Advantageously, passing the temperature protection circuit to minimum function circuit 310 functions to perform excess temperature de-rating only when the excess temperature de-rating calls for an amplitude of current lower than that called for by the lowest value of the various dimming control inputs to minimum function circuit 310.

Figure 4:
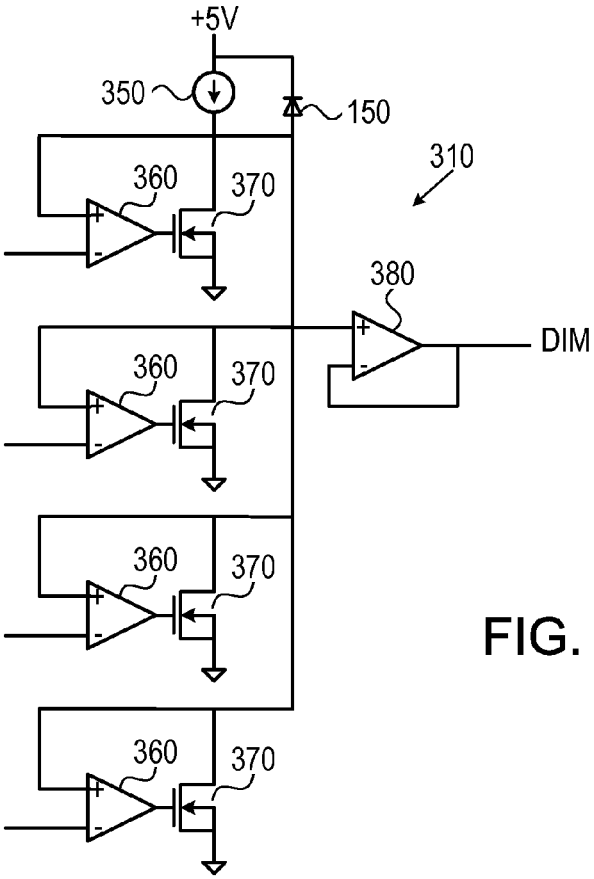
FIG. 4 illustrates a high level schematic diagram of an exemplary embodiment of the minimum function circuit of FIG. 2.

FIG. 4 illustrates a high level schematic diagram of an exemplary embodiment of minimum function circuit 310 of FIG. 2 comprising: a plurality of differential amplifiers 360; a plurality of electronically controlled switches 370, each implemented as an NMOSFET; a current source 350; a unidirectional electronic valve 150; and a buffer 380 implemented as a differential amplifier whose output is fed back to its inverting input. Each of the various inputs to minimum function circuit 310 are connected to the inverting input of a respective differential amplifier 360, and the output of each respective differential amplifier 360 is connected to the gate of a respective electronically controlled switch 370. The drain of each electronically controlled switch 370 is connected to the non-inverting input of the respective differential amplifier 360, to the input of buffer 380, to the output of current source 350 and to the anode of unidirectional electronic valve 150. The cathode of unidirectional electronic valve 150 and the input of current source 350 are connected to a maximum value, illustrated without limitation as +5V. A compensation capacitor (not shown) is preferably further supplied between the input of buffer 380 to the secondary side common point to stabilize the operation of minimum function circuit 310.

In operation, the high gain of each of the differential amplifiers 360 functions to control the respective electronically controlled switch 370 to drive down the value at the input of buffer 380 to meet the respective input value. The lowest input value will dominate, since the respective electronically controlled switch 370 will continue to conduct while the balance of the electronically controlled switches 370 are cut off until the input to buffer 380 reaches the lowest input value.

Figure 5:
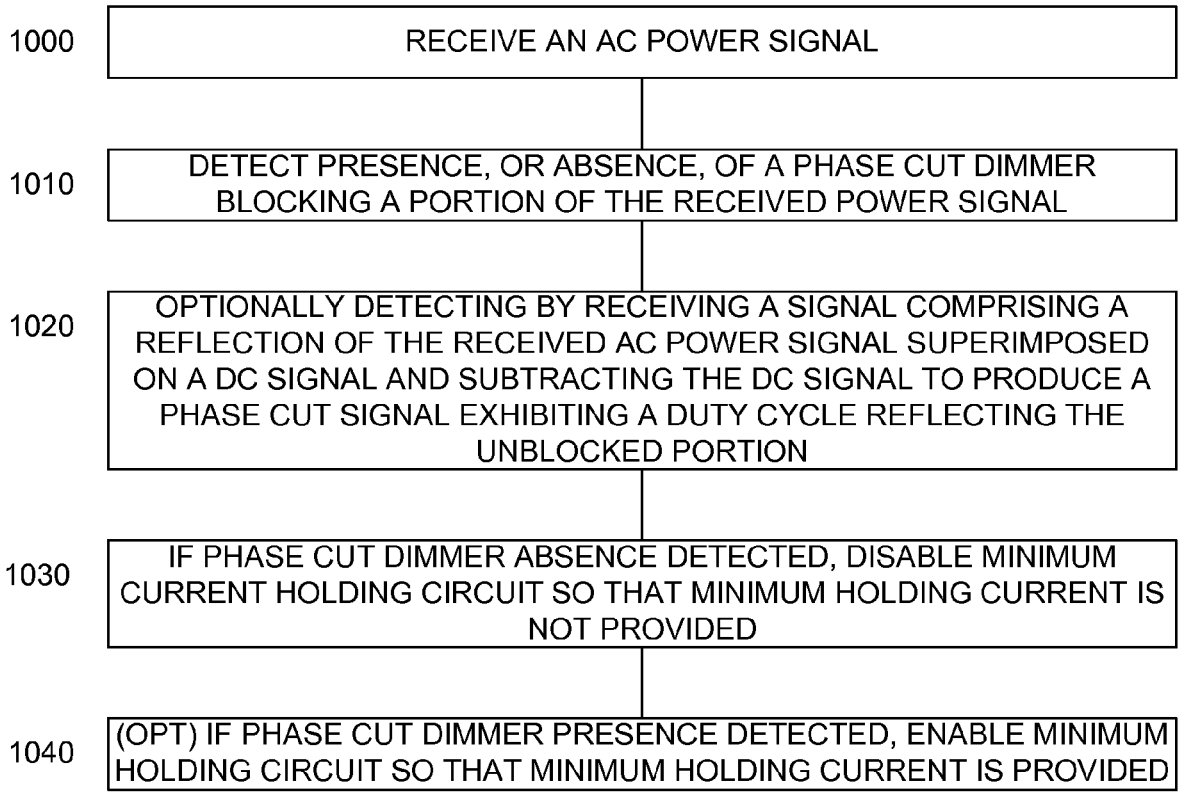
FIG. 5 illustrates a high level flow chart of an exemplary embodiment of a method of providing a selectable hold current.

FIG. 5 illustrates a high level flow chart of an exemplary embodiment of a method of providing a selectable hold current. In stage 1000 an AC power signal is received. In stage 1010 the presence, or absence, of a phase cut dimmer blocking a portion of the received power signal sine wave is detected. Optionally, as described in stage 1020, detection of the presence, or absence, of the phase cut dimmer is accomplished by receiving a signal comprising a reflection of the received AC power signal of stage 1000 superimposed on a DC signal, as described above in relation to signal SNB, and subtracting the DC signal to produce a phase cut signal whose duty cycle reflects the unblocked portion of the received AC power signal of stage 1000, as described above in relation to signal PHASECUT.

In stage 1030, in the event that the absence of a phase cut dimmer is detected in stage 1010, a minimum holding current circuit is disabled so that a minimum holding current is not provided, thus saving power. In optional stage 1040, in the event that the presence of a phase cut dimmer is detected in stage 1010, a minimum holding current circuit is enabled so that a minimum holding current is provided supporting the detected phase cut dimmer.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described herein above. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

I claim:

1. A power saving arrangement for use with a phase cut dimmer, the power saving arrangement comprising:

a power converter arranged to convert a received alternating current power signal to a direct current signal, said power converter comprising a primary side, a secondary side isolated from the primary side and an auxiliary power winding isolated from the primary side;

a detector arranged to detect the presence, or absence, of the phase cut dimmer blocking a portion of an alternating current mains power sine wave from reaching the power converter, said detector coupled to the power converter secondary side, said detector arranged to:

receive a signal comprising a reflection of the received alternating current power signal superimposed onto a direct current signal; and subtract the direct current signal from the received signal, and a controllable minimum holding current circuit in communication with the received alternating current power signal, said controllable minimum holding current circuit responsive to an output of said detector, wherein in the event that said detector detects the absence of the phase cut dimmer, the controllable minimum holding current circuit is disabled such that a minimum holding current is not provided.

2. The power saving arrangement according to claim 1, wherein in the event that said detector detects the presence of the phase cut dimmer, the controllable minimum holding current circuit is enabled such that the minimum holding current is provided.

3. The power saving arrangement according to claim 1, wherein said power converter is a flyback converter.

4. A power saving arrangement for use with a phase cut dimmer, the power saving arrangement comprising:

a power converter arranged to convert a received alternating current power signal to a direct current signal, wherein said power converter comprises a flyback converter having a primary side switch connected in series with a primary side winding, and wherein said flyback converter further comprising a secondary side winding magnetically coupled with the primary side winding;

a detector arranged to detect the presence, or absence, of the phase cut dimmer blocking a portion of an alternating current mains power sine wave from reaching the power converter, wherein said detector comprises a unidirectional electronic valve connected to the secondary side winding of the flyback converter, said unidirectional electronic valve arranged to output a reflection of the received alternating current signal superimposed on a direct current signal when said primary side switch is closed; and a controllable minimum holding current circuit in communication with the received alternating current power signal, said controllable minimum holding current circuit responsive to an output of said detector, wherein in the event that said detector detects the absence of the phase cut dimmer, the controllable minimum holding current circuit is disabled such that a minimum holding current is not provided.

5. The power saving arrangement according to claim 4, wherein said detector further comprises:

a subtraction circuit arranged to subtract the direct current signal from the received reflection of the alternating current signal superimposed on the direct current signal and output a phase cut signal exhibiting a duty cycle, wherein the duty cycle is a function of the alternating current signal, and wherein the direct current signal is output by the secondary side winding.

6. The power saving arrangement according to claim 5, further comprising a low pass filter connected between said unidirectional electronic valve and said subtraction circuit.

7. The power saving arrangement according to claim 5, further comprising a conversion circuit arranged to convert the output phase cut signal to a phase cut level signal.

8. The power saving arrangement according to claim 7, further comprising a comparing circuit arranged to compare the phase cut level signal to a reference, wherein in the event that said phase cut level does not exceed the reference the presence of the phase cut dimmer is detected, and in the event that the phase cut level signal exceeds the reference the absence of the phase cut dimmer is detected.

9. A power saving arrangement comprising:

a detector arranged to detect the presence, or absence, of a phase cut dimmer blocking a portion of an alternating current mains power sine wave from reaching a power converter;

a power converter comprising a flyback converter having a primary side switch connected in series with a primary side winding, and a secondary side winding magnetically coupled with the primary winding; and a controllable minimum holding current circuit in communication with the power converter, said controllable minimum holding current circuit responsive to an output of said detector, wherein in the event that said detector detects the absence of the phase cut dimmer, the controllable minimum holding current circuit is disabled such that a minimum holding current is not provided, and wherein said detector comprises a unidirectional electronic valve connected to the secondary winding of said flyback converter, said unidirectional electronic valve arranged to output a reflection of a received alternating current signal superimposed on a direct current signal when said primary side switch is closed.

10. The power saving arrangement according to claim 9, wherein in the event that said detector detects the presence of the phase cut dimmer, the controllable minimum holding current circuit is enabled such that the minimum holding current is provided.

11. The power saving arrangement according to claim 9, wherein said detector further comprises:

a subtraction circuit arranged to subtract the direct current signal from the received reflection of the alternating current signal superimposed on the direct current signal and output a phase cut signal exhibiting a duty cycle, wherein the duty cycle is a function of the alternating current signal, and wherein the direct current signal is output by the secondary side winding.

12. The power saving arrangement according to claim 11, further comprising a low pass filter connected between said unidirectional electronic valve and said subtraction circuit.

13. The power saving arrangement according to claim 11, further comprising a conversion circuit arranged to convert the output phase cut signal to a phase cut level signal.

14. The power saving arrangement according to claim 13, further comprising a comparing circuit arranged to compare the phase cut level signal to a reference, wherein in the event that said phase cut level does not exceed the reference the presence of the phase cut dimmer is detected, and in the event that the phase cut level signal exceeds the reference the absence of the phase cut dimmer is detected.

15. A method of providing a selectable minimum holding current, the method comprising:

receiving an alternating current power signal;

detecting the presence, or absence, of a phase cut dimmer blocking a portion of a mains power sine wave from the received alternating current power signal; and disabling, in the event that said detecting detects the absence of the phase cut dimmer, a minimum holding current circuit such that a minimum holding current is not provided, wherein said detecting comprises:

receiving a signal comprising a reflection of the received alternating current power signal superimposed onto a direct current signal; and subtracting the direct current signal to produce a phase cut signal which exhibits a duty cycle reflective of the unblocked portion of the alternating current power sine wave.

16. The method according to claim 15, further comprising:

enabling, in the event that said detecting detects the presence of the phase cut dimmer, the controllable minimum holding current circuit such that the minimum holding current is provided.

* * * * *